US006217242B1

(12) United States Patent
Cote

(10) Patent No.: US 6,217,242 B1
(45) Date of Patent: Apr. 17, 2001

(54) SCENTED WRITING IMPLEMENT

(76) Inventor: Christopher W. E. Cote, 301 - 1300 Hunter Road, Delta, B.C. (CA), V4L 1Y8

( * ) Notice: Subject to any disclaimer, the term of this patent is extended or adjusted under 35 U.S.C. 154(b) by 0 days.

(21) Appl. No.: 09/580,948

(22) Filed: May 30, 2000

(51) Int. Cl.[7] ..... B43K 75/00
(52) U.S. Cl. ..... 401/52; 401/195; 401/49
(58) Field of Search ..... 49/52, 195; 428/905; 401/49, 50

(56) References Cited

U.S. PATENT DOCUMENTS 3,660,055 * 5/1972 Haller ..... 44/6
3,888,416 * 6/1975 Lin ..... 401/195
5,233,371 * 8/1993 Guillet ..... 351/111

* cited by examiner

*Primary Examiner*—David J. Walczak
(74) *Attorney, Agent, or Firm*—Oyen Wiggs Green & Mutala

(57) ABSTRACT

A fragrant pencil and a method of making same. The pencil is made from an absorbent material which is soaked in a liquid fragrance.

11 Claims, 2 Drawing Sheets

SCENTED WRITING IMPLEMENT

TECHNICAL FIELD

The present invention relates to writing implements such as pencils and in particular a writing implement impregnated with a scent, fragrance or aroma

BACKGROUND ART

Pencils are typically constructed of a cylindrical wood casing surrounding a graphite core. The exterior of the wood casing may or may not be coated with a coating such as paint and/or lacquer. The wood casing is partially removed at one end to expose some of the core, such as graphite, for the purpose of writing, drawing or marking. The pencil may or may not have an eraser attachment affixed to one end of the pencil by a fastener such as a ferrule etc. Few modifications of the basic pencil to make it more interesting have been introduced over the years, and consequently there has been little to choose as between different models of pencil.

It is therefore an object of the present invention to provide a pencil having a novel feature, namely an impregnated scent, aroma or fragrance.

DISCLOSURE OF INVENTION

The invention therefore provides a pencil comprising a solid elongated body surrounding a core of marking material, wherein the elongated body is impregnated with a fragrance. The invention further provides a method of manufacturing a fragrant pencil comprising:

a) providing an uncoated pencil made from an absorbent material;

b) submerging the pencil in a bath of liquid fragrance for a period of time sufficient for such pencil to absorb said fragrance;

c) removing said pencil from said bath and allowing it to dry.

BRIEF DESCRIPTION OF DRAWINGS

In drawings which disclose a preferred embodiment of the invention, which are provided for the purpose of illustration only and not limitation:.

BEST MODE(S) FOR CARRYING OUT THE INVENTION

Figure 1:
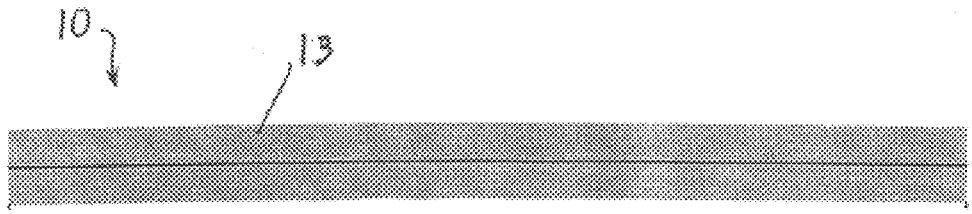
FIG. 1 is an elevation view of a writing implement in accordance with the present invention.
Figure 2:
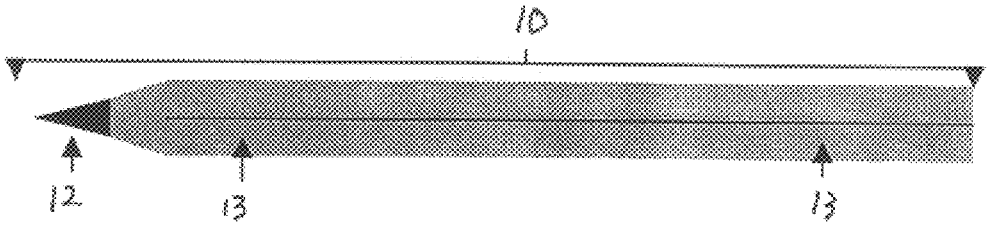
FIG. 2 is an elevation view of the implement shown in FIG. 1 in sharpened condition.
Figure 3:
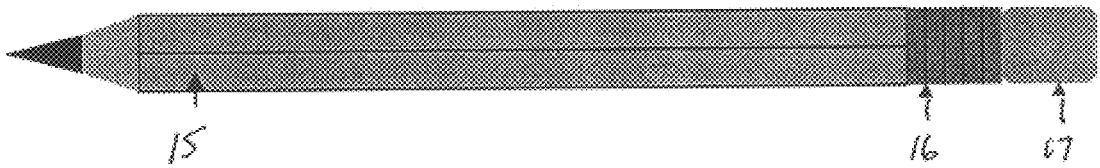
FIG. 3 is an elevation view of the writing implement shown in FIG. 2 provided with an eraser.

A standard pencil 10 comprises a cylindrical core 12 of graphite or other marking material, and a solid, rigid cylindrical casing 13 surrounding core 12. As further described below, the novelty of the present invention is that the casing 13 is impregnated with an aroma, scent or fragrance. Pencil

10 may include a coating 15 applied on the exterior of the casing 13, and an eraser attachment 17 affixed to the casing 13 by a metal ferrule 16 in the conventional way.

Figure 4:
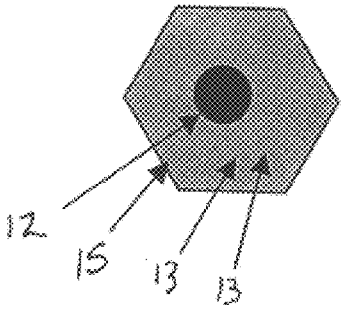
FIG. 4 is a cross sectional view taken along lines A—A of FIG. 1.
Figure 5:
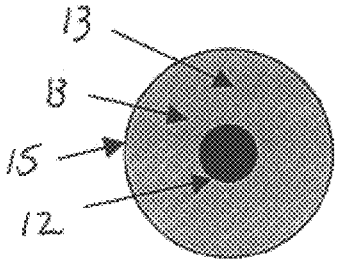
FIG. 5 is a cross sectional view of a second embodiment of the invention having a circular cross-sectional shape.
Figure 6:
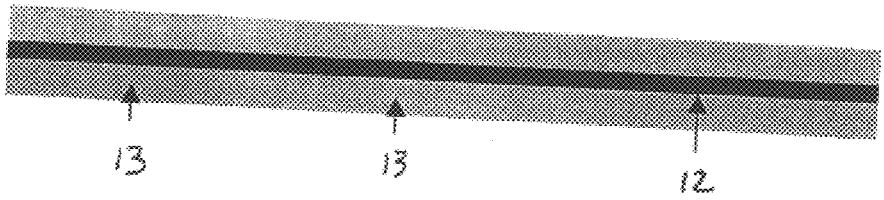
FIG. 6 is a longitudinal sectional view taken along lines B—B of FIG. 4.
Figure 7:
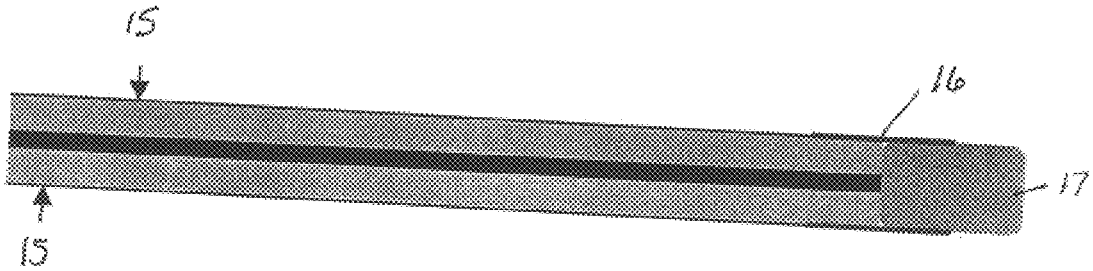
FIG. 7 is a longitudinal sectional view taken along lines A—A of FIG. 5.

As in conventional pencils, the casing 13 is typically a rigid cylinder of either hexagonal or circular cross-section shape as shown in FIGS. 4 and 5 respectively with a hollow cylindrical central core running continuously along the length of the casing 13 for accommodating the writing core 12. Whereas in conventional pencils the casing 13 typically is made of wood, in the present invention the casing material is preferably compressed newsprint impregnated with fragrance. Pencils made from compressed newspaper bonded by resin are currently manufactured by Tree Smart, Inc. of Lake Oswego, Oreg., and it has been found that such pencils are suitable for impregnating with fragrance. The uncoated newspaper pencils are submerged into a bath of liquid fragrance such as strawberry, coffee, honey-nut, etc. and allowed to soak for approximately 30 minutes. Because they are made of absorbent paper, they absorb the liquid fragrance. Liquid dyes may be added to the liquid fragrances for the purpose of adding color to the casing. They are then allowed to dry for up to approximately 30 minutes. After drying, the pencil body is dry to the touch and leaves little or no residue on a person's hand, and can hold the fragrance for up to six months or more. The liquid fragrances are purchased from fragrance manufacturers and are non-toxic chemical formulations that are either water, alcohol or glycol soluble.

After the pencils have dried, an adhesive label or banner may be placed around the body of the pencil immediately below the eraser and ferrule with a trademark or logo of the manufacturer or that of a corporate sponsor. Alternatively, a layer and/or layers of paint and/or lacquer may be applied to the exterior of the casing 13 for the purpose of adding color to the writing implement and/or providing protection for the casing 13 and reducing the evaporation of fragrance.

Thus, while the pencil according to the invention will always emit some fragrance, when a portion of the casing 13 is removed during sharpening, a sharply increased amount of fragrance will be emitted. This will encourage the user to frequently sharpen the pencil to obtain the pleasant sensation of the fragrance.

Thus, according to the present invention, since the casing of the writing implement is impregnated with the fragrance, the casing may emit the fragrance for the enjoyment of the human operating the writing implement while maintaining the ability to write and/or draw and/or erase.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A pencil comprising a solid elongated body of absorbent material surrounding a core of marking material, wherein said absorbent material is impregnated with a fragrance and upon sharpening of said pencil a portion of said solid body is removable to expose a portion of said core of marking material and to expose a portion of said body of absorbent material to the atmosphere.

2. The pencil of claim 1 wherein said elongated body comprises paper.

3. The pencil of claim 2 wherein said elongated body comprises newspaper.

4. The pencil of claim 3 wherein said elongated body comprises compressed newspaper.

5. The pencil of claim 1 wherein said elongated body is coated with a coating.

6. A method of manufacturing a fragrant pencil comprising:

a) providing a pencil made from an absorbent material;

b) submerging said pencil in a bath of liquid fragrance for a period of time sufficient for such pencil to absorb said fragrance;

c) removing said pencil from said bath and allowing it to dry.

7. The method of claim 6 wherein said pencil is made from paper.

8. The method of claim 6 wherein said pencil is uncoated.

9. The method of claim 6 wherein said liquid fragrance is water, alcohol or glycol soluble.

10. The method of claim 6 comprising the further step of coating said pencil after it has dried.

11. The method of claim 6 comprising the further step of adding a liquid dye to said bath of liquid fragrance.

* * * * *